United States Patent [19]

Kutowy

[11] 4,395,130

[45] Jul. 26, 1983

[54] INTERCONNECTED PUMPING MECHANISM

[76] Inventor: Oleh Kutowy, R.R. #3, North Gower, Ontario, Canada

[21] Appl. No.: 249,938

[22] Filed: Apr. 1, 1981

[51] Int. Cl.[3] ..... B01F 5/12

[52] U.S. Cl. ..... 366/137; 241/46.17; 366/76; 366/295; 366/296; 415/59; 415/66; 415/74; 417/250

[58] Field of Search ..... 366/349, 91, 83, 84, 366/88, 76, 137, 136, 161, 292–296; 415/60, 102, 67, 68, 66, 59, 71–74, 143, 52, 53; 416/120, 128, 129; 417/248, 250; 241/46.17

[56] References Cited

U.S. PATENT DOCUMENTS

| | | | |
|---|---|---|---|
| 872,361 | 12/1907 | Marburg | 415/72 |
| 885,553 | 4/1908 | Wheeler | 415/66 |
| 1,049,651 | 1/1913 | Bennett | 415/72 |
| 1,091,887 | 3/1914 | Long | 416/128 |
| 1,316,139 | 9/1919 | Cake | 416/128 |
| 3,154,808 | 11/1964 | Ahlefeld | 366/76 |
| 3,976,453 | 8/1976 | Brown | 415/72 |
| 3,985,348 | 10/1976 | Skidmore | 366/76 |
| 4,260,739 | 4/1981 | Geyer | 366/91 |
| 4,289,409 | 9/1981 | Brand | 366/83 |

FOREIGN PATENT DOCUMENTS

| | | |
|---|---|---|
| 565930 | 11/1958 | Canada . |
| 569285 | 1/1959 | Canada . |
| 574816 | 4/1959 | Canada . |
| 588457 | 12/1959 | Canada . |
| 623140 | 7/1961 | Canada . |
| 634944 | 1/1962 | Canada . |
| 664418 | 6/1963 | Canada . |
| 679875 | 2/1964 | Canada . |
| 713837 | 7/1965 | Canada . |
| 781753 | 4/1968 | Canada . |
| 783942 | 4/1968 | Canada . |
| 809422 | 4/1969 | Canada . |
| 855975 | 11/1970 | Canada . |
| 1081539 | 7/1980 | Canada . |

*Primary Examiner*—Robert W. Jenkins
*Attorney, Agent, or Firm*—Birch, Stewart, Kolasch & Birch

[57] ABSTRACT

A novel dual or more interconnected pumping mechanisms pump is provided herein. It comprises a first pumping mechanism within a casing. A first pumping mechanism is provided within the casing, the first pumping mechanism having an operating shaft within the casing, the operating shaft being operated by a motor. The first pumping mechanism has pumping structure so constructed and arranged as exclusively to provide a high pressure, low volume aqueous liquid flow, the first pumping mechanism having axial output. A second pumping mechanism is also provided within the casing, and is in direct liquid flow connection with the first pumping mechanism, the second pumping mechanism also having an operating shaft within the casing, the operating shaft being operated by the same motor. The second pumping mechanism has pumping structure so constructed and arranged as exclusively to provide a low pressure, high volume aqueous liquid flow. The second pumping mechanism has an axial input in direct liquid flow connection to the axial output of the first pumping mechanism. It has a first radial port at the liquid flow connection between the first pumping mechanism and the second pumping mechanism, and a second port at the opposite end thereof. A connection is made between the first pumping mechanism and the second pumping mechanism, the connection being within the casing and being in the axial path of liquid flow, thereby obviating the need of the shaft seal between the output of the first pumping mechanism and the input of the second pumping mechanism. This obviates the need for a shaft seal at the second pumping mechanism and eliminates plural motors and plural seals with their attendant frictional losses and leaks at the seals. Consequently, total horsepower requirements are lower.

20 Claims, 7 Drawing Figures

INTERCONNECTED PUMPING MECHANISM

BACKGROUND OF THE INVENTION (i) Field of the Invention

This invention relates to a novel pumping system.

(ii) Description of the Prior Art

For many pumping uses there is a requirement to have a "two pump" system. One of the pumps provides high pressure at low fluid flows, while the second pump provides a high flow rate with low fluid head requirements. The common practice heretofore has been to utilize individual pumps or to use, as the second pump, magnetically coupled pumps which would not leak.

A severe problem exists in pumping and/or metering fluids at high pressures where leakage of one or both of the fluids can cause damage to the environment or a loss of valuable material. Among other limitations to the present pumping system are the fact that two motors are required and that the second pump usually has leakage problems at the shaft. Furthermore, the frictional losses at the seal vary directly with the pressure. Moreover, in this system, each pump requires a motor and a means of sealing the fluid from the motor. In magnetically coupled pumps: (a) only very clean liquids may be pumped; (b) only low heads can be accomplished; and (c) as the volume to be pumped increases, the pump size and operating pressure decrease. At any rate, if one of the pumps or motors fails, the process can be disrupted causing possibly large losses of material or equipment.

Another common practice utilizes one pump to provide high pressure and flow requires high hose pressure. A disadvantage of such practice is that the fluid is continuously pressurized and then depressurized at a pressure regulator and consequently that energy is lost in pressurizing and depressurizing.

Many patents purport to provide improvements in flow regulating or mixed flow pumps.

Canadian Pat. No. 565,930 issued Nov. 11, 1958 to Karl Wernert, Mulheml-Ruhr, Germany, provides a variable output rotary pump structure, including a centrifugal pump, an adjacent rotary pump and a common driving shaft. The structure is such that when the centrifugal pump reaches a set pressure, it automatically cuts out the rotary pump.

Canadian Pat. No. 569,285 issued Jan. 20, 1959 to Strausak & Cie., Lohn, Switzerland, provides a flow-regulatory pumping device for fuel supply. In the patent, two pumps (a first fixed delivery and a second variable delivery) are driven from a common shaft and are connected in series relative to fuel flow. Structure is provided to control and measure the amount of fuel delivered by each pump.

Canadian Pat. No. 574,816 issued Apr. 28, 1959 to Thompson Products, Inc., Cleveland, U.S.A., provides a mixed flow multiple pump. The invention includes the combination of a main positive displacement pump and an auxiliary, low-inlet-loss, centrifugal pump placed in series ahead of the main positive displacement pump.

Canadian Pat. No. 588,457 issued Dec. 8, 1959 to Borg Warner Corp., Chicago, Ill., U.S.A., provides a staging-type altitude fuel pump. It provides a high capacity first stage to supply a necessary high volume of fuel at a high pressure, and a second stage pump which operates at low inlet pressures and high vapor-liquid ratios. The inventive combination uses two pumps for the first stage, one pump to provide the second pump with the necessary volume of fluid at high pressure, and an auxiliary pump to assist the main pump during periods of adverse conditions.

Canadian Pat. No. 623,140 issued July 4, 1961 to United Shoe Machinery Company of Canada, Limited, Montreal, Quebec, provides a pump for use in blood circulation. A pair of compressible tube rotary impeller-type pumps are connected in such a way to the human body that one pump is connected to venous blood and the other pump is connected to arterial blood. Both pumps are operated by the same shaft.

Canadian Pat. No. 634,944 issued Jan. 23, 1962 to Sven A. Noren, Stockholm, Sweden, provides a combined pump device. The patent includes a viscosity-type pump operatively and directly connected to the inlet of a displacement-type pump so that it operates with a velocity proportional to the velocity of the displacement pump. This provides a greater pressure at the inlet side of the displacement-type pump.

Canadian Pat. No. 664,418 issued June 4, 1963 to Gilbert R. Funk and Robert E. Holtgrieve, Waukesha, Wis., U.S.A., provides a metering pump. In the patent, a primary pump to supply the high pressure and a secondary pump with pressures balanced across it are provided in which the rotors of the pump are mounted on the same shaft. The inventive contribution involves connecting a meter with the common shafting. The amount delivered by the series-connected pumps will be the amount displaced by the metering pump.

Canadian Pat. No. 679,875 issued Feb. 11, 1964 to The Weatherhead Company, Cleveland, Ohio, U.S.A., provides a pump cooling apparatus. In the inventive concept, a variable displacement pump is coupled with a secondary or centrifugal pump so that there is a flow of fluid through the pump and between the pump and a reservoir as a result of a pressure differential created by the secondary or centrifugal pump. The secondary pump is connected to the reservoir.

Canadian Pat. No. 713,837 issued July 20, 1965 to Danfoss ved ing. M. Clausen, Nordborg, Denmark, provides a two stage gear pump, namely, a suction stage pump and a pressure stage pump. The invention provides an axial sealing surface for the suction pump, the sealing surface being in the form of an oil relief valve.

Canadian Pat. No. 781,753 issued Apr. 2, 1968 to George R. Sosemn et al., Burbank, Calif., U.S.A. provides a plural output pump. The single pumping device can pump two or more fluids at the same or different output pressures and at the same or different volumetric ratios. It includes a fixed displacement primary pump and a variable displacement secondary pump. There is an interrelated pumping mechanism between the first and second pumps.

Canadian Pat. No. 783,942 issued Apr. 30, 1968 to Drysdale & Company Limited, Glasgow, Scotland, provides a fluid supply apparatus. According to the invention, the inlet of a centrifugal pump is connected to a source of fluid and its outlet is connected to the inlet of a positive displacement pump which is connected to the fluid system.

Canadian Pat. No. 809,422 issued Apr. 1, 1969 to Siemen & Hinsch mbH, Itzehoe/Holstein, Germany, provides a reversible rotary pump. According to the invention, the reversible rotary pump is provided with a side channel shape designed for optimum operation in one direction of fluid flow. A second side channel stage is designed for optimum operation in the opposite direction of fluid flow. The two side channel stages are connected to operate in series. The pump is also provided with reversible drive means.

Canadian Pat. No. 855,975 issued Nov. 17, 1970 to Von Roll AG., Gerlatingen, Switzerland, provides a multiple unit hydraulic pump. The independent pumping mechanisms are disposed within a common housing. This can allow the housing to include a built-in reservoir.

Canadian Pat. No. 1,081,539 issued July 15, 1980 to W. F. Krueger, is directed to pumping apparatus for pumping metered quantities of material from one location to another. The pumping means includes a pair of pump cylinders. Ball check valves and back pressure interconnection means are also provided.

By U.S. Pat. No. 4,054,544 issued Oct. B 18, 1977 to H. Penhexter, apparatus is provided for exposing a fluid to a negative pressure.

Basically according to this patent, an apparatus is provided for subjecting a fluid to a negative pressure. The apparatus includes a receptacle with a partition reciprocable therein and dividing the cylinder into two chambers. The partition is arranged to sweep a lesser volume in one of those chambers than is swept in the other chamber. A fluid is admitted to the smaller volume chamber as that chamber expands and is delivered from the smaller volume chamber to the larger volume chamber as the larger chamber expands. As the partition reverses and moves to expand the smaller volume chamber, fluid is moved out of the larger volume chamber to a separating means.

U.S. Pat. No. 4,070,280 issued Jan. 24, 1980 to Desalination Systems Inc., provides apparatus for purifying water by reverse osmosis operable by a handle or pedal. The reverse osmosis apparatus of this patent includes a pump for pressurizing feed water introduced into a pressure resistant container in which is slidably mounted a semi-permeable membrane cartridge. A rod, attached to an end of the semi-permeable membrane cartridge, passes slidably and sealingly through one end of the pressure resistant container and is connected to means for reciprocal actuation. Means, preferably common, are provided to actuate the pump and the rod which imparts longitudinal reciprocal motion to the rod and the membrane cartridge within the pressure resistant container, thereby providing improved turbulence and circulation of the feed water through the semi-permeable membrane cartridge over the membrane surfaces. The common means may be in the form of a lever operated by a handle or pedal, or by a power source such as an electric motor.

U.S. Pat. No. 4,096,052 issued June 20, 1978 to H. Pinkerton provides apparatus for and a method of accurately proportioning and mixing fluids. The patentee in U.S. Pat. No. 4,096,052 provides apparatus for accurately proportioning and mixing fluids comprising a double acting piston/cylinder unit of which the cylinder is divided into two chambers by the piston and the volume of the cylinder swept by the piston at one end of the piston is lesser than that at the other end. An inlet connection for a first fluid is made to one chamber, a conduit connects the two chambers and includes a connection to a source of the second fluid. Valve means are associated with the conduits and are effective to cause a charge of first fluid to be delivered to one chamber and thereafter to be transferred to the other chamber drawing fluid from the source of a second fluid to make up for the difference in the volumes of the chambers. The valve means then cooperate to cause the mixed fluids to be discharged from the other chamber as the one chamber is again charged with the first fluid.

U.S. Pat. No. 4,172,033 issued Oct. 23, 1979 to DWS Inc., relates to an artificial kidney system which includes first apportioning means for providing at least a substantial part of the dialysate solution for a dialyzer, and second apportioning for receiving dialysate solution from the dialyzer. Means coordinate the operation of the second apportioning means with the first apportioning means for predetermining the ratio of dialysate solution passing in and out of the dialyzer. A negative pressure means and a pressure reducer are disposed in that order between the dialyzer and the second pump for providing a predetermined constant pressure to the input of the second pump while sufficient negative pressure is applied to the dialyzer for supplying just the quantity of dialysate solution demanded by the second pump. The negative pressure means suitably comprises a pumping device and a bypass connected thereacross. According to the ratio of pumping rates selected for the first and second pumps, the amount of fluid withdrawn or even added can be accurately predetermined.

U.S. Pat. No. 4,178,240 issued Dec. 11, 1979 to H. Pinkerton provides a system for handling two liquid streams comprising an hydraulic circuit including a pair of receptacles each provided with movable partition means dividing it into first and second chambers. Rod means extending through a first chamber of each receptacle connects the partition means and is effective to cause reciprocation of one partition means to be repeated by the other so that as the first chamber of one receptacle is expanded, the first chamber of the other receptacle is contracted. A quantity of the first liquid is delivered alternately to the first and second chambers of the receptacle as those chambers expand. As those chambers contract first liquid is passed through conduit means from the first and second chambers of the one receptacle to the first and second chambers, respectively, of the other receptacle. A source of second liquid is connected to the conduit means and liquid removal means is connected to the conduit to remove liquid from the circuit in quantities equal to the quantity of second liquid admitted to the circuit.

U.S. Pat. No. 4,197,196 issued Apr. 8, 1980 to H. Pinkerton provides an improvement in the hemodialysis system of his U.S. Pat. No. 4,096,052, including a dialyzer having a semi-permeable membrane, apparatus for accurately proportioning and mixing fluids comprising a double acting piston/cylinder unit of which the cylinder is divided into two chambers by the piston and the volume of the cylinder swept by the piston at one end of the piston is lesser than at the the other end.

SUMMARY OF THE INVENTION (i) Aims of the Invention

In spite of all the solutions purported to be found in these patents, the pumping and/or metering of fluids at high pressure results in leakage of one or both of the fluids which can cause damage to the environment (if the fluid is radioactive) and/or loss of fluid. An object of this invention, then, is to provide an improved pumping system in which such problem is greatly minimized.

The present invention thus attempts to provide a pumping device which will virtually eliminate the problems of the present systems as well as provide the same capabilities at lower power consumption and lower overall cost.

(ii) Statement of Invention

The essence of the present invention is to replace the two pumps with a dual pump having two or more pumping or operating elements driven by one motor. The two or more pumping elements deliver fluids at prescribed rates, pressures and directions of flow according to need. The pumping elements may be centrifugal, positive displaced, progressive cavity, turbine, or simple screw or mascerator type, or may be a combination of up to four or even more elements joined at the coupling point.

By this invention, then, a dual pump is provided comprising: (a) a casing; (b) a first pumping mechanism within the casing, the first pumping mechanism having an operating shaft within the casing, the operating shaft being operated by a motor, the first pumping mechanism having pumping structure so constructed and arranged as exclusively to provide a high pressure, low volume liquid flow, the first pumping mechanism having axial output; (c) a second pumping mechanism within the casing, in direct liquid flow connection with the first pumping mechanism, the second pumping mechanism having an operating shaft within the casing, the operating shaft being operated by the same motor, the second pumping mechanism having an axial input in direct liquid flow connection to the axial output of the first pumping mechanism, the second pumping mechanism having a first radial port at the direct liquid flow connection between the first pumping mechanism and the second pumping mechanism, and a second port at the opposite end thereof, the second pumping mechanism having pumping structure so constructed and arranged as exclusively to provide a low pressure, high volume aqueous liquid flow; and (d) a connection between the first pumping mechanism and the second pumping mechanism, the connection being within the casing and being in the direct axial path of liquid flow, thereby obviating the need of the shaft seal between the output of the first pumping mechanism and the input of the second pumping mechanism.

This invention also provides a method for separating one element in a solution from another element in that solution comprising: (a) feeding the solution into a dual pump comprising (1) a first pumping mechanism within a first casing and having an operating shaft within the casing, the operating shaft being operated by a motor, (2) a second pumping mechanism within the same first casing or within a second casing integrally joined to the first casing, the second pumping mechanism having an operating shaft within the second casing, the operating shaft being operated by the same motor, and (3) a connection between the two pumping mechanisms, the connection being within the casing and being in the path of fluid flow; (b) withdrawing the solution from the output of the second pumping element of the dual pump; (c) passing the solution through a working element; and (d) recirculating the output from the working element back to the input of the second pumping mechanism.

(iii) Other Features of the Invention

By a first feature of this invention, the first pumping mechanism has a radial inlet.

By another feature, the first radial port of the second pumping mechanism is an inlet, and the second port is an outlet at the distant end of the second pumping mechanism.

By still another feature, the outlet is an axial outlet.

By yet another feature, the first radial port of the second pumping mechanism is a combined outlet for the first pumping mechanism and the second pumping mechanism, and the second port is an inlet at the distant end of the second pumping mechanism.

By a further feature, the inlet is a radial inlet.

By a further feature, the axial outlet from the second pumping mechanism comprises the inlet to a recirculation system including a working element therein, and the radial inlet to the second pumping mechanism comprises the outlet of the recirculation system.

By another feature, only the first operating shaft enters the casing through a bearing and high pressure seal.

By yet another feature, the first pumping element is a centrifugal element, a positive displacement element or a progressive cavity element; and the second pumping element the same or different is a centrifugal element, a positive displacement element or a progressive cavity element.

By still another feature, the first pumping element and the second pumping element are operated by a common operating shaft.

By a still further feature, the operating shaft of the first pumping element is operatively coupled to the operating shaft of the second pumping mechanism.

By another feature, the operative coupling is by a direct gear drive.

By yet another feature, the operative coupling is by a magnetic coupling.

By another feature, two outputs are provided, a primary output from the second pumping mechanism, and an auxiliary output from the first pumping mechanism the flow volume thereof comprising the difference between the flow volume of the input to the first pumping mechanism and the flow volume of output from the second pumping mechanism.

By a further feature, the input to the first pumping mechanism is radial, the primary output is axial and the auxiliary output is radial.

By yet another feature, the dual pump is for metering two aqueous liquids wherein the axial output in a first flow direction from the first pumping mechanism is merged with the axial output in an opposite flow direction of the second pumping mechanism to provide a common mixed aqueous liquid radial fluid output.

By a feature thereof, the operating shaft of the first pumping mechanism is rotating in a direction opposite to that of the second pumping mechanism.

By another feature, the pumping mechanisms thereby cause liquid flow in opposite directions from the individual radial inlets to the common radial output.

By yet a further feature, the dual pump is for dissolving a solid in a solvent wherein the first pumping mechanism comprises a positive displacement pumping mechanism with a solvent input thereto, and wherein the second pumping mechanism comprises a a second mascerator mechanism with a solids input thereinto.

By a further feature, the dual pump is for mixing heterogeneous substances comprising a first pumping mechanism having a radial inlet and an axial output, a second pumping mechanism having an axial inlet in direct flow connection from the axial output of the first pumping mechanism and a radial inlet to the axial inlet, and an axial output and a recycle loop connected between the axial output of the second pumping mechanism and the radial input to the second pumping mechanism; the first pumping mechanism comprises a first positive displacement pumping mechanism; the second pumping mechanism comprises a second positive displacement pumping mechanism and including a third high shear pump loop with a solids/liquid mixed axial output from the second pumping mechanism and a recycle loop connected between the axial output and the radial input.

BRIEF DESCRIPTION OF THE DRAWINGS

In the accompanying drawings.

Figure 1:
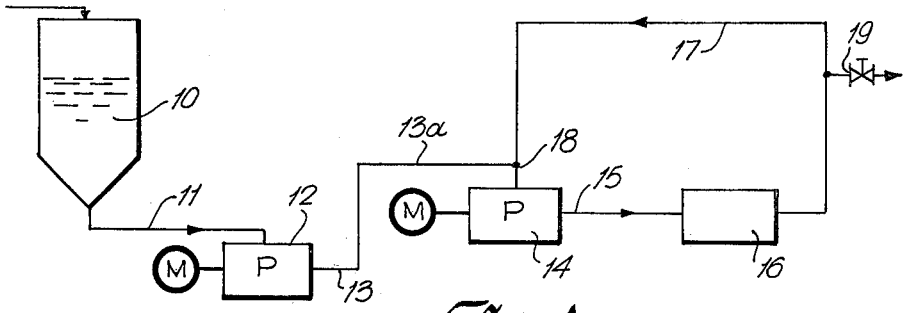
Fig. 1 (PRIOR ART)
FIG. 1 is a schematic flow diagram of one pumping system of the prior art.

DESCRIPTION OF PREFERRED EMBODIMENTS (i) Description of Prior Art in FIG. 1

As seen in the prior art system of FIG. 1, a feed tank 10 feeds liquid flow via line 11 to the inlet of the first pump 12 at a given head. The first pump 12 can, for example, pump 0.1–10 gpm at a pressure of 100–1000 psi. The outlet line 13 of the first pump 12 feeds the inlet of the second pump 14. Second pump 14 can, for example, pump 1–300 gpm at a differential pressure of 10–300 psi plus the pressure of the first pump 12, but within the outlet pressure range of the first pump 12. The outlet line 15 of the second pump 14 feeds liquid to the working element 16 and recirculates the liquid in line 17 back to the inlet line 13*a* of the second pump 14 at T-joint 18. A pressure bleed-off 19 is provided in the recirculation line 17.

The prime disadvantage of this prior art system is, as noted two motors and the leakage at the shaft to the motor of pump 14.

Figure 2:
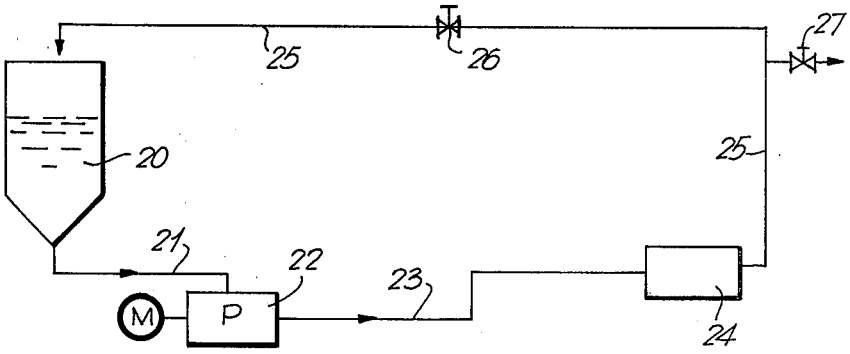
Fig. 2 (PRIOR ART)
FIG. 2 is a schematic flow diagram of a second pumping system of the prior art.

(ii) Description of Prior Art in FIG. 2

As seen in the prior art system of FIG. 2, the feed tank 20 feeds liquid flow via line 21 to the pump 22. Pump 22 can, for example, pump 1–300 gpm at pressures from 100–1300 psi. The outlet from pump 22 passes via line 23 to the working element 24, and then via return line 25 through back pressure regulator 26 back to feed tank 20. A pressure bleed-off 27 is also provided in line 25.

The prime disadvantage of this prior art system is, as described above, that the pump 22 must work to build up the high pressure, and then such energy and power is wasted at the back pressure regulator 26. The size of the pump 22 would also be very large.

Figure 3:
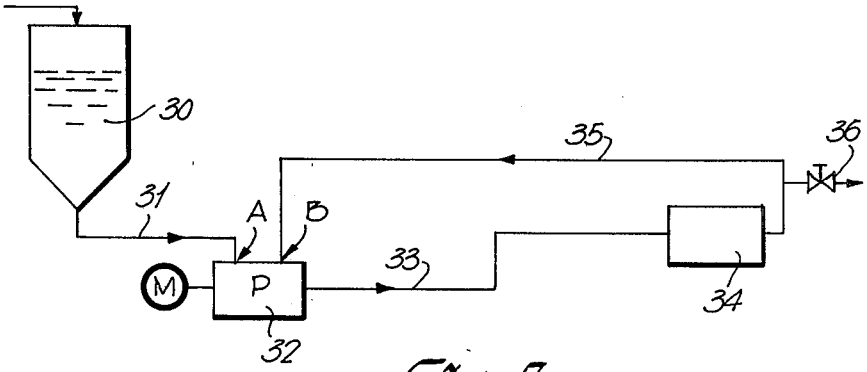
FIG. 3 is a schematic flow diagram of the pumping system of this invention.

(iii) Description of Embodiment of FIG. 3

The schematic system of an embodiment of the present invention is shown in FIG. 3 and consists of a pair of interconnected pumps therein designated commonly as 32 in which the pumps are part of a recirculation loop. Here, the feed tank 30 feeds interconnected pump 32 at point A with liquid via line 31. The inlet pressure in line 31 to pump 32 is the hydraulic head and the outlet pressure in outlet line 33 can, for example, be from 100–1000 psi.

Outlet line 33 leads to the working element 34 and then, via recirculator line 35, back to interconnected pump 32 at point B. A pressure bleed-off 36 from recirculator line 35 is also provided.

Figure 4:
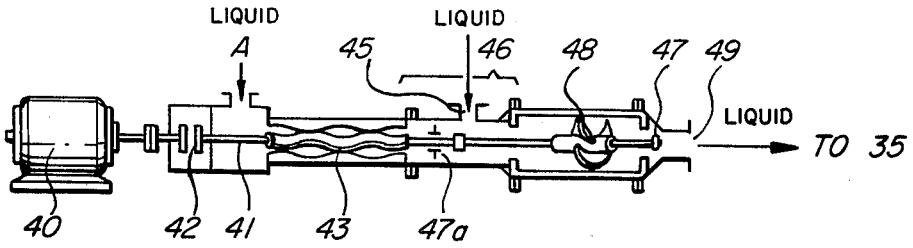
FIG. 4 is a schematic cross-sectional view of a dual mated pump of one feature of this invention.

(iv) Description of Preferred Embodiment of FIG. 4

As seen in FIG. 4, the motor 40 is attached by a standard coupling or by any conventional type of speed reducer or increaser (not shown) to the pump shaft 41. The shaft 41 goes through a standard bearing and high pressure sealing mechanism 42. The shaft 41 is part of, or is connected to, the first pumping element 43 which is a high pressure pump, preferably one of a positive displacement type, e.g., that known by the Trade Mark MOYNO or a multistage centrifugal type, e.g., that known by the Trade Mark GOULDS. The shaft 41 continues through a connecting assembly 46 integral with the casing, assembly 46 including the recirculating fluid inlet 45. Shaft 41 (with or without support bearings 47*a*, 47) is connected to the second pumping element 48. The second pumping element 48 provides a high recirculation rate with enough pressure development to overcome pressure drops in the circulation loop 35 (see FIG. 3). The working element (not shown) is thus connected between pump outlet 49 and pump inlet 45. In one preferred embodiment as shown, the two pumping elements 43, 48 are coupled directly at the connecting port 45 and work at the same speed.

Figure 5:
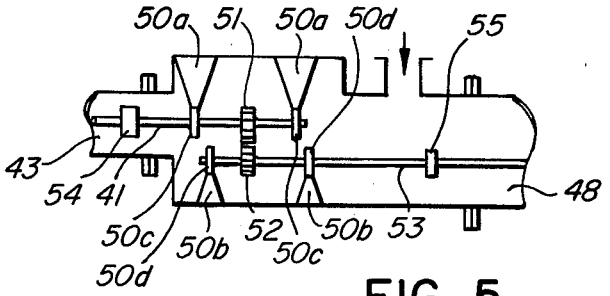
FIG. 5 is a schematic cross-sectional view of a dual mated pump of a second feature of this invention.

(v) Description of Embodiment of FIG. 5

When the pumping requirements are such that the two pumping elements 43, 48 should work at different speeds, an alternate gearing arrangement as shown in FIG. 5 may be used. In this embodiment, the connecting assembly would house the bearing supports 50*a*, 50*b* and gears 51, 52. Shaft 41 passes through a simple coupling element 54 and runs in upper bearings 50*c*. A drive gear 51 is splined to drive shaft 41, and meshes with driven gear 52 splined to driven shaft 53. Shaft 53 runs in lower bearings 50*d* and passes through a simple coupling element 55 to drive the second pump element 48.

If there is to be a fixed ratio between the first pump and the second pump, then the connector should be a solid connection. On the other hand, if there is to be a variable ratio, then the connector may be a fluid drive transmission or a magnetic coupling, or a motor movement.

Figure 6:
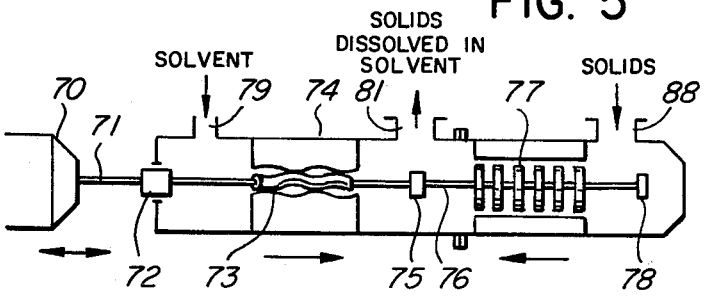
FIG. 6 is a schematic cross-sectional view of a dual mated pump of yet another feature of this invention.

(vi) Description of Embodiment of FIG. 6

The interconnected pump may also be used as a metering pump as shown in FIG. 6. Here, motor 70 drives shaft 71 which passes through high pressure seal and bearing 72 to drive the first pumping mechanism 73 in a casing 74. In one variant, shaft 71 then enters reversing gearing mechanism 75 so that the rotation of shaft 76 outgoing from reversing gearing mechanism 75 is opposite to the rotation of incoming shaft 71. In another variant, element 75 is a simple coupling and the pumping mechanism 77 is of a mirror image construction to pumping element 73. This allows the fluids to flow in opposite directions as shown by the arrows. Shaft 76 drives second pumping mechanism 77 and is supported in a simple bearing 78.

Inlet to the interconnected pump is to the first pumping mechanism 73 via first radial inlet 79 and to the second pumping mechanism 77 via second radial inlet 88, and outlet from both the first pumping mechanism 73 and the second pumping mechanism 77 is by common central radial outlet 81. If the inlet volumes at 79 and 88 are $V_1$ and $V_2$, respectively, the output volume at 81 is $V_1$ and $V_2$. This provides a volumetrically accurate mixing at any desired pressure and flow rate.

Figure 7:
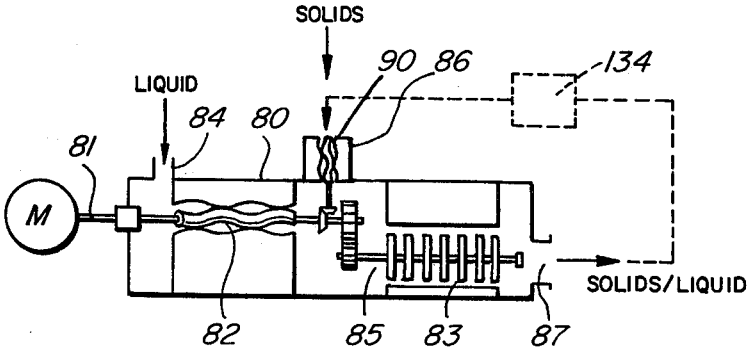
FIG. 7 is a schematic representation of a plural pump for dissolving a solid in a solvent or for mixing heterogeneous substances.

(vii) Description of Embodiment of FIG. 7

As shown schematically in FIG. 7, motor M drives operating shaft 81 which operates first pumping mechanism 82 and second pumping mechanism 83 within a casing 80. Liquid solvent inlet to first pumping mechanism is via inlet 84. Liquid solvent at the proper flow and pressure ratio feeds second pumping mechanism 83 through the region 85 of the direct liquid flow connection between the axial output of the first pumping mechanism 82 and axial input of the second pumping mechanism 83. Solids are fed to second pumping mechanism 83 via inlet 86 containing a metering screw 90. Solids are withdrawn from second pumping mechanism outlet 87. The output from outlet 87 may alternatively be recirculated in a loop, to a working element 134, all shown in dot-and-peck.

In one variant of the use of the apparatus of FIG. 7, solids to be dissolved, e.g., synthetic plastic material, is fed to the second pumping mechanism 83 which is preferably a mascerator. Solids dissolved in the solvent are withdrawn at 87.

In another variant, a first liquid, e.g., water, enters first pumping mechanism 82 via inlet 84 and is pumped to second pumping mechanism 83 at the desired pressure and volume through region 85. Solids, e.g., coal, are fed to second pumping mechanism 83 via inlet 86 and the metering screw 90. The coal/water heterogeneous mixture is fed to second pumping mechanism 83, preferably a high shear mixer. A coal/water slurry is then withdrawn through outlet 87 from second pumping mechanism 83.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A dual pump comprising:

(a) a casing;

(b) a first pumping mechanism within said casing, said first pumping mechanism having an operating shaft within said casing, said operating shaft being operated by a motor, said first pumping mechanism having pumping structure so constructed and arranged as exclusively to provide a high pressure, low volume liquid flow, said first pumping mechanism having axial output;

(c) a second pumping mechanism within said casing, in direct liquid flow connection with said first pumping mechanism, said second pumping mechanism having an operating shaft within said casing, said operating shaft being operated by the same said motor, said second pumping mechanism having an axial input in direct liquid flow connection to said axial output of said first pumping mechanism; said second pumping mechanism having a first radial port at said direct liquid flow connection between said first pumping mechanism and said second pumping mechanism, and a second port at said opposite end thereof; said second pumping mechanism having pumping structure so constructed and arranged as exclusively to provide a low pressure, high volume aqueous liquid flow; and (d) a connection between said first pumping mechanism and said second pumping mechanism, said connection being within said casing and being in the direct axial path of said liquid flow, thereby obviating the need of the shaft seal between the output of said first pumping mechanism and the input of said second pumping mechanism.

2. The dual pump of claim 1 wherein: said first pumping mechanism has a radial inlet.

3. The dual pump of claim 2 wherein said first radial port of said second pumping mechanism is an inlet, and wherein said second port is an outlet at the distant end of said second pumping mechanism.

4. The dual pump of claim 3 wherein said outlet is an axial outlet.

5. The dual pump of claim 4 wherein said axial outlet from said second pumping mechanism comprises the inlet to a recirculation system including a working element therein, and wherein said radical inlet to said second pumping mechanism comprises the outlet of said recirculation system.

6. The dual pump of claim 2 wherein said first radial port of said second pumping mechanism is a combined outlet for said first pumping mechanism and said second pumping mechanism, and wherein said second port is an inlet at the distant end of said second pumping mechanism.

7. The dual pump of claim 6 wherein said inlet is a radial inlet.

8. The dual pump of claim 1 wherein said operating shaft enters said casing to drive said first pumping mechanism through a bearing and high pressure seal.

9. The dual pump of claim 1 wherein said first pumping element is selected from a centrifugal element, a positive displacement element and a progressivecavity element; and wherein said second pumping element is selected from the same or different centrifugal element, positive displacement element and progressive cavity element.

10. The dual pump of claim 1 wherein said first pumping element and said second pumping element are operated by a common operating shaft.

11. The dual pump of claim 1 wherein said operating shaft of said first pumping element is operatively coupled to the operating shaft of the second pumping mechanism.

12. The dual pump of claim 11 wherein said operative coupling is by means of a direct gear drive.

13. The dual pump of claim 11 wherein said operative coupling is by means of a magnetic coupling.

14. The dual pump of claim 1 wherein two outputs are provided, said outputs comprising a primary output from said second pumping mechanism, and an auxiliary output from said first pumping mechanism, the flow volume thereof comprising the difference between the flow volume of the input to said first pumping mechanism and the flow volume of the output from said second pumping mechanism.

15. The dual pump of claim 14 wherein said input to said first pumping mechanism is radial, wherein said primary output is axial and wherein said auxiliary output is radial.

16. The dual pump of claim 1 for metering aqueous liquids wherein said first pumping mechanism is merged with said axial output in an opposite flow direction of said second pumping mechanism to provide a common mixed aqueous liquid radial output.

17. The dual pump of claim 16 wherein said operaing shaft of said first pumping mechanism is rotating in a direction opposite to that of said second pumping mechanism.

18. The dual pump of claim 17 wherein said pumping mechanism thereby cause liquid flow in opposite directions from said invidual radial inlets to said common radial output.

19. The dual pump of claim 1 for dissolving a solid in a solvent wherein said first pumping mechanism comprises a positive displacement pumping mechanism with a solvent input thereto, and wherein said second pumping mechanism comprises a mascerator mechanism with a solids input thereinto.

20. The dual pump of claim 1 for mixing heterogeneous substances comprising a first pumping mechanism having a radial inlet and an axial output, a second pumping mechanism having an axial inlet in direct flow connection from said axia output of said first pumping mechanism and a radial inlet to said axial inlet, and an axial output and a recycle loop connected between said axial output of said second pumping mechanism and said radial input to said second pumping mechanism; wherein said first pumping mechanism comprises a first positive displacement pumping mechanism; wherein said second pumping mechanism comprises a second positive displacement pumping mechanism and including a high shear pump loop with a solids/liquid mixed axial output from said second pumping mechanism and recycle loop connected between said axial output and said radial input.

* * * * *